US008274350B2

(12) United States Patent
Hanov et al.

(10) Patent No.: US 8,274,350 B2
(45) Date of Patent: Sep. 25, 2012

(54) ELECTRIC WINDING BODY AND TRANSFORMER HAVING FORCED COOLING

(75) Inventors: Rudolf Hanov, Weilheim (DE); Fritz Sorg, Stuttgart (DE)

(73) Assignee: Siemens Aktiengesellschaft, Munich (DE)

( * ) Notice: Subject to any disclaimer, the term of this patent is extended or adjusted under 35 U.S.C. 154(b) by 148 days.

(21) Appl. No.: 12/680,337

(22) PCT Filed: Sep. 28, 2007

(86) PCT No.: PCT/EP2007/008631

§ 371 (c)(1),
(2), (4) Date: Mar. 26, 2010

(87) PCT Pub. No.: WO2009/046733

PCT Pub. Date: Apr. 16, 2009

(65) Prior Publication Data

US 2011/0175696 A1 Jul. 21, 2011

(51) Int. Cl.
*H01F 27/02* (2006.01)

(52) U.S. Cl. ..... 336/59

(58) Field of Classification Search ..... 336/55–62
See application file for complete search history.

(56) References Cited

U.S. PATENT DOCUMENTS

| | | | |
|---|---|---|---|
| 4,173,747 | A | 11/1979 | Grimes et al. |
| 6,262,503 | B1 | 7/2001 | Liebman et al. |
| 6,924,723 | B1 | 8/2005 | Bouldin et al. |
| 2006/0044103 | A1 | 3/2006 | Roebke et al. |

FOREIGN PATENT DOCUMENTS

| | | | |
|---|---|---|---|
| CN | 1873855 | A | 12/2006 |
| DE | 1056730 | B | 5/1959 |
| GB | 671287 | A | 4/1952 |
| WO | 9834239 | A1 | 8/1998 |

*Primary Examiner* — Tuyen Nguyen

(74) *Attorney, Agent, or Firm* — Laurence A. Greenberg; Werner H. Stemer; Ralph E. Locher

(57) ABSTRACT

An electrical winding body includes an electrically conductive winding and an insulation surrounding the winding. The surrounding insulation surrounds the entire winding and forms a mechanically stable winding body. At least one continuous channel having an opening in the electrical winding body is disposed inside the winding body. An extension element is placed in the openings of the continuous channels to elongate the channels beyond the dimensions of the electrical winding body, thus providing for improved cooling. Side elements are additionally attached on the outer wall of the electrical winding body to create an intermediate space which forms a new cooling channel that produces an additional cooling effect due to an air current created by the chimney effect.

6 Claims, 7 Drawing Sheets

ELECTRIC WINDING BODY AND TRANSFORMER HAVING FORCED COOLING

BACKGROUND OF THE INVENTION

Field of the Invention

The invention relates to an electrical winding body having an electrically conductive winding and insulation surrounding the winding, wherein the surrounding insulation surrounds the entire winding and forms a mechanically robust winding body, and at least one continuous channel having an opening in the electrical winding body is arranged within the electrical winding body. The invention also relates to a transformer having an electrical winding body according to the invention. The electrical winding bodies are part of a transformer.

The thermal load on a transformer, in particular a cast-resin transformer, has a considerable influence on the life of the transformer. Adequate cooling of the windings is therefore essential in particular for air-cooled transformers, such as cast-resin transformers.

By way of example, EP 0092204 A2 describes an induction coil wherein, according to the invention there, cooling channels are arranged between the winding, and are used to cool the winding. According to the invention there, an insulation cylinder is likewise arranged around the winding, for electromagnetic shielding.

Furthermore, DE 37 32 670 A1 discloses an arrangement of a transformer and of a pylon in an overhead line system for electricity transmission. According to the invention there, an air-cooled transformer is used in an overhead line pylon, wherein the part of the pylon which is above ground level is in the form of a chimney, and the transformer is supported, under the transformer, on a pylon foot.

Furthermore, laid-open specification DE 27 13 183 describes an apparatus for cooling a transformer. Corresponding to the invention there, a transformer is provided having an attachment or an insert such that the heat which is created throughout the entire transformer and in the transformer internal area above the insert can be carried away by the chimney-like attachment.

The solutions known from the prior art have the disadvantage that extensive structural components must for this purpose be arranged around the transformer and/or fitted in the transformer station. Upgrading of an existing transformer with cooling channels, in particular of a cast-resin transformer, is, according to the solutions known from the prior art, possible only by extensive design measures, and in many cases no appropriate physical space is available around the transformer.

BRIEF SUMMARY OF THE INVENTION

The object of the present invention is therefore to provide improved cooling, which can be implemented easily, for a transformer with cooling channels.

The invention provides that an extension element directly surrounds the opening of the continuous channel on the surface of the electrical winding body and the continuous channel beyond the external dimensions of the electrical winding body is thus lengthened. The extension of the cooling channel and/or of the internal recess in the electrical winding body by means of the extension element beyond the external dimensions of the electrical winding body reinforces the so-called chimney effect within the cooling channels. This ensures a greater air flow rate and therefore improved cooling through the cooling channels. The extension of the inner or outer area of the electrical winding body likewise results in improved cooling between the inner windings and the core, which can be arranged in the interior of the electrical winding body.

The use of the extension element for fitting around the opening of the continuous channels in the electrical winding body allows existing transformers, in particular cast-resin transformers, to be retrofitted simply and quickly, thus ensuring improved cooling. The present invention therefore makes it possible to considerably extend the operating life of the transformer.

In contrast to the solutions in the prior art, according to the present invention, only the air circulation within the cooling channels is improved, and in fact this does not lead to complex convection patterns of the solutions known in the prior art. In fact, in the prior art, the different temperature and flow conditions on the upper face of the transformers lead to a very complex convection pattern above the entire transformer, which can impede forced air cooling. The alternating sequence of the openings of the cooling channels in conjunction with the surrounding solid upper material of the heated winding body thus produces a complex convection pattern of the air above the entire electrical winding body. In the case of a polyphase transformer, the air flows above the various electrical winding bodies in the transformer additionally influence one another such that no air flow directed exclusively upward occurs above the continuous channels in the transformer.

The present invention ensures that a forced flow of the cooling medium, for example air, occurs only within the cooling channels. The temperature and flow patterns of the air at the end of the extension element actually no longer influence the temperature and flow conditions on the immediate surface of the electrical winding body to the same extent as the solutions in the prior art.

One advantageous refinement of the electrical winding body provides that the extension element can be pushed into the continuous channel. The use of an elastic extension element provides the capability to insert the extension element into the channel with virtually corresponding diameters of the channel and of the extension element, and in this way to ensure simple retrospective installation of the extension element on the transformer.

Alternatively, the extension element is designed such that, with respect to the longitudinal axis of the extension element, the extension element is in the form of a cylinder and has two overlapping ends in the longitudinal direction. The overlap of the ends in the longitudinal direction of the cylinder ensures that the diameter of the extension element can be varied to a major extent without adversely affecting the cylindrical shape, and thus ensuring a chimney effect. The electrical characteristics of the extension element are in this case chosen such that the open cylinder on its own increases the cylinder radius and can thus be fixed to the inner wall of the continuous channel, without any further aids, when it is inserted within the continuous channel.

In order to improve the through-flow of the cooling medium, and therefore force the chimney effect, the extension element has a different cross section and/or diameter with respect to the longitudinal axis. The extension element is advantageously likewise at least partially inclined—with respect to the longitudinal axis of the extension element. The partial inclination of the extension element makes it possible to also guide the channel beyond the dimensions of the electrical winding body in the case of a physically poor arrangement above the electrical winding body. In particular, the extensions of the channel around a yoke which is located above the electrical winding body can be ensured by means of an appropriate angled configuration of the extension element.

The extension element is advantageously manufactured from an elastic and/or flexible material.

In order to assist the vertical movement of the cooling medium through the continuous channels, which are likewise arranged vertically, the connecting element is arranged on at least one of the end faces—with respect to the longitudinal axis of the electrical winding body. In particular, the arrangement of the extension element above or below the electrical winding body ensures that the vertical channel path is extended and therefore ensures improved cooling because of the chimney effect.

In one advantageous refinement of the electrical winding body, the extension element can be fixed by means of attachment means to the opening. Attachment of the extension element in the immediate vicinity of the opening by means of suitable attachment elements results in the extension element being connected to the electrical winding body in a mechanically robust manner. By way of example, attachment means may be angled elements which are at the same time arranged on the end surface of the electrical winding body and on the lower face of the extension element.

Furthermore, it is possible to use a closure element, in which case corresponding formed-out areas of a closure element, for example a bayonet fitting, are feasible around the opening of the continuous channel and the extension element. The extension element could then be inserted into a holder, arranged around the opening of the continuous channel, of a bayonet fitting, and could be locked by rotation of the extension element.

In order to improve the cooling of the outer surfaces of the electrical winding body, a side element is advantageously arranged radially on the electrical winding body with respect to the longitudinal axis of the electrical winding body, such that the intermediate space created in this way results in an additionally continuous channel on the outer face of the electrical winding body. The fitting of a side element advantageously provides an additional cooling channel around the electrical winding body, and thus further improves the cooling characteristics.

The side element is advantageously shaped such that the cooling medium is transported to the electrical winding body via a large air inlet, and a narrower channel, and therefore an increased chimney effect, are created by a short distance for this purpose between the side element and the outer wall of the electrical winding body. The side element is advantageously designed such that the air inlet can suck in a large amount of air as a cooling medium, and can use this for the cooling process within the electrical winding body. This can be ensured by an appropriate air inlet. The air inlet can advantageously be open over the entire length, with respect to the longitudinal axis of the electrical winding body, or may be arranged in the form of a partial opening within a side element which otherwise completely surrounds the electrical winding body.

The air inlet is advantageously aligned in the direction of an increased external air flow. When using the present invention in regions where there is a severe climatic influence, for example in the high seas, the air inlet can be aligned with a preferred flow direction and/or wind direction when the electrical winding body is installed in an unprotected manner in the surrounding medium. In this case, the air inlet is then used as a type of wind trap, such that the normal air flow assists the chimney effect in cooling the electrical winding body. The side element and/or extension element are/is advantageously formed at least partially from a plastic. This ensures simple production, and the extension element or side element can easily be fitted in or on the electrical winding body.

The side element is advantageously attached to the outer wall of the electrical winding body by holding elements, for example rods. The distance between the side element and the outer wall of the electrical winding body can be determined by the size and shape of the holding elements, thus defining the width and shape of the intermediate space which is created in the intermediate space between the side element and the electrical winding body. The holding element can either form a point connection to the electrical winding body, in the form of a rod at one of the corners of the side element, or alternatively a large-area holder may produce a connection to the electrical winding body for example along the entire longitudinal face of the side element—with respect to the longitudinal axis of the side element.

The object is likewise achieved by a transformer having at least one core which can be magnetized, having a yoke and having at least two limbs, as well as at least two electrical winding bodies each having an electrically conductive winding and insulation surrounding the respective winding, wherein the surrounding insulation surrounds the respective winding and in each case forms a mechanically robust winding body, and an electrical winding body is arranged on one limb. The invention provides that at least one separating element is arranged between two electrical winding bodies, wherein the separating element comprises at least two side elements, which can be fixed to one another at the rear. The capability to attach the side elements such that they can be fixed to one another at the rear allows the separating element to be fitted easily and retrospectively between the electrical winding bodies. The separating elements can advantageously be fitted with the core, in particular the yoke, and/or directly to at least one winding body.

In one advantageous refinement of the transformer, the side elements of the separating element can be fixed by means of at least one attachment element at the rear wall, wherein the force effect of the attachment element on the side elements influences the shape of the side elements. According to the present invention, the attachment element, in particular a screw connection, is used not only for mutual attachment of the side elements which are arranged at the rear, but also for shaping and therefore matching of the side elements to the physical characteristics of the intermediate space between the electrical winding bodies, and/or to the external shape of the electrical winding bodies.

The side elements of the separating element are advantageously shaped, in particular corrugated, such that the shape of the side elements can be varied deliberately in the case of a force from the attachment element. The shape of the side elements can be varied continuously, and therefore matched, by a predeterminable different force acting from the attachment element on the side elements. Different shapes of the side elements of the separating element which are attached at the rear can be ensured, with the same force acting from the attachment element, by different shapes of the side elements of a separating element. For this purpose, it is advantageous for the side elements of the separating element to be manufactured from an elastic material.

In one advantageous refinement of the transformer, the side elements of the separating element have different attachment points, such that the shape of the side elements can be varied by a force from a plurality of attachment elements on the side elements. The relative length distance between specific points on the side elements, and therefore the shape of the side elements, can be adjusted by the fixing of a plurality of attachment points of the side elements, for example predeterminable holes in the side elements are connected by means of variable length screw connections. In order to ensure that the side elements which have been combined to form a separating element have a different shape, it is also possible for a different material of the side elements to produce a different shape, in addition to a deviating form. By way of example, the bolts have a diameter of 15 mm and a short step, for example with a diameter of only 9 mm, at both ends. If the flexible plate material has holes of 10 mm, for example, the short ends of the bolts can be inserted into these holes, and the extent of the deflection of the side elements in the direction of a circular section is governed by the length of the cylindrical 15 mm part.

In one advantageous refinement of the transformer, at least one winding body with an extension element is part of the transformer. This provides very effective cooling for the transformer. The separating elements advantageously project, like the extension elements, beyond the external dimensions of the electrical winding bodies, in particular cast-resin winding bodies, and ensure effective cooling of the transformer.

Further advantageous refinements of the present invention are specified in the dependent claims.

BRIEF DESCRIPTION OF THE SEVERAL VIEWS OF THE DRAWING

The invention will be explained in more detail in the following text using exemplary embodiments by way of example. In this case, by way of example.

DESCRIPTION OF THE INVENTION

Figure 1:
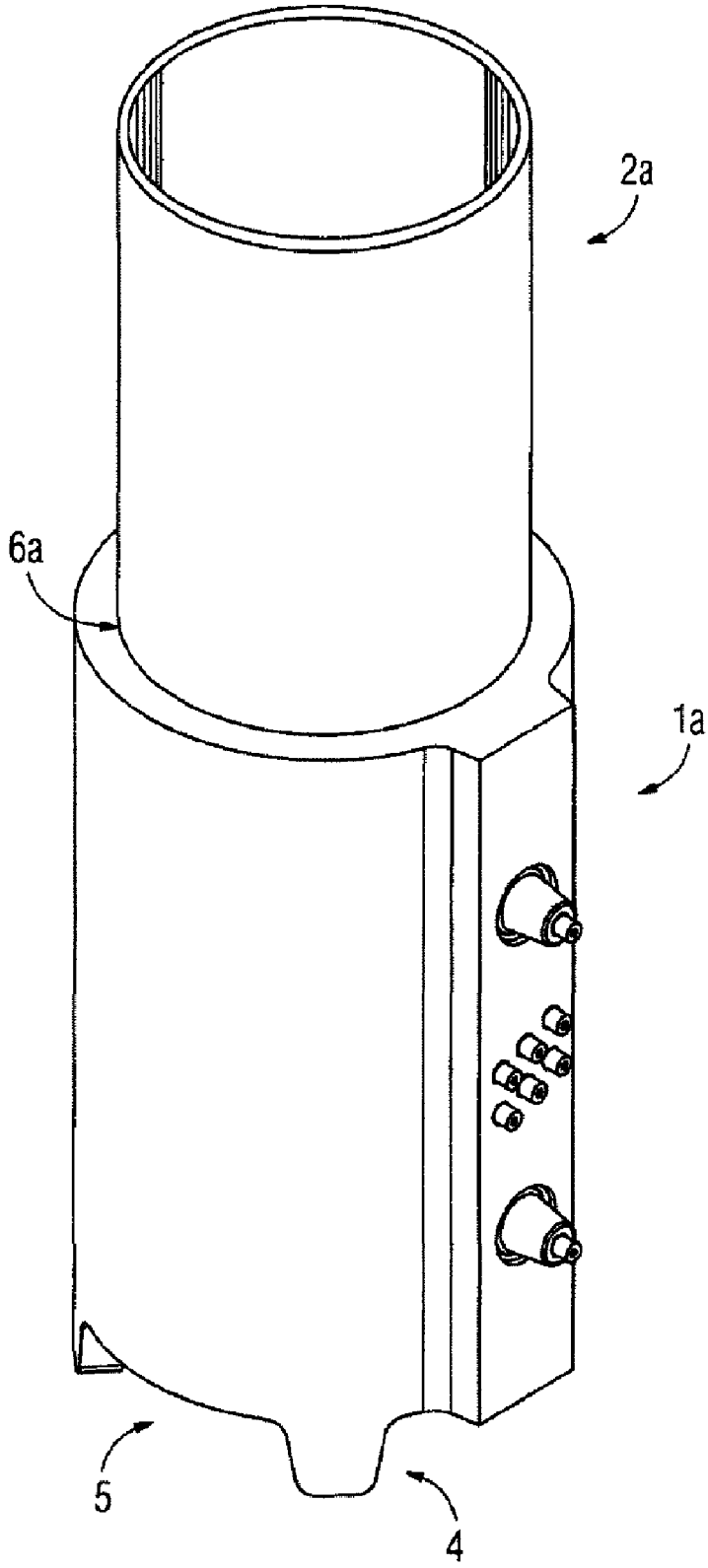
FIG. 1 shows a perspective view of the electrical winding body with an extension element.

FIG. 1 shows a perspective view of the electrical winding body 1*a* with feet 4 which form a gap 5 under the electrical winding body 1*a*. Air can flow from below into the continuous channels 10*a*, 10*b*, 10*c* (10*a* is not illustrated) through the gap 5. A core which can be magnetized can be inserted into the continuous center channel 10*a* (not illustrated) in the electrical winding body 1*a*, such that the electrical winding body 1*a* can be used as part of a transformer. An extension element 2*a* can be inserted into the continuous channel 10*a* and, for example, is in the form of a cylinder. The cooling medium, in particular air, can be carried away from the electrical winding body 1*a* through the upper opening of the cylinder. The air passes via the gap 5 into one of the continuous channels 10*a* to 10*c*, and flows out of the opening of the extension element 2*a*, by virtue of the chimney effect. The present invention greatly reduces and impedes any influence on the flow and convection conditions immediately above the end surface of the electrical winding body 1*a*.

As it passes through the channel 10*a*, the cooling medium absorbs the heat from the surrounding electrical winding body 1*a*, thus creating a chimney effect. The air that has been heated in this way flows out at high speed through the extended opening 6*a* in the continuous channel 10*a*. The air flow emerging from the opening 6*a* is therefore passed out further beyond the end face of the electrical winding body 1*a*, by means of the extension element 2*a*.

Figure 2:
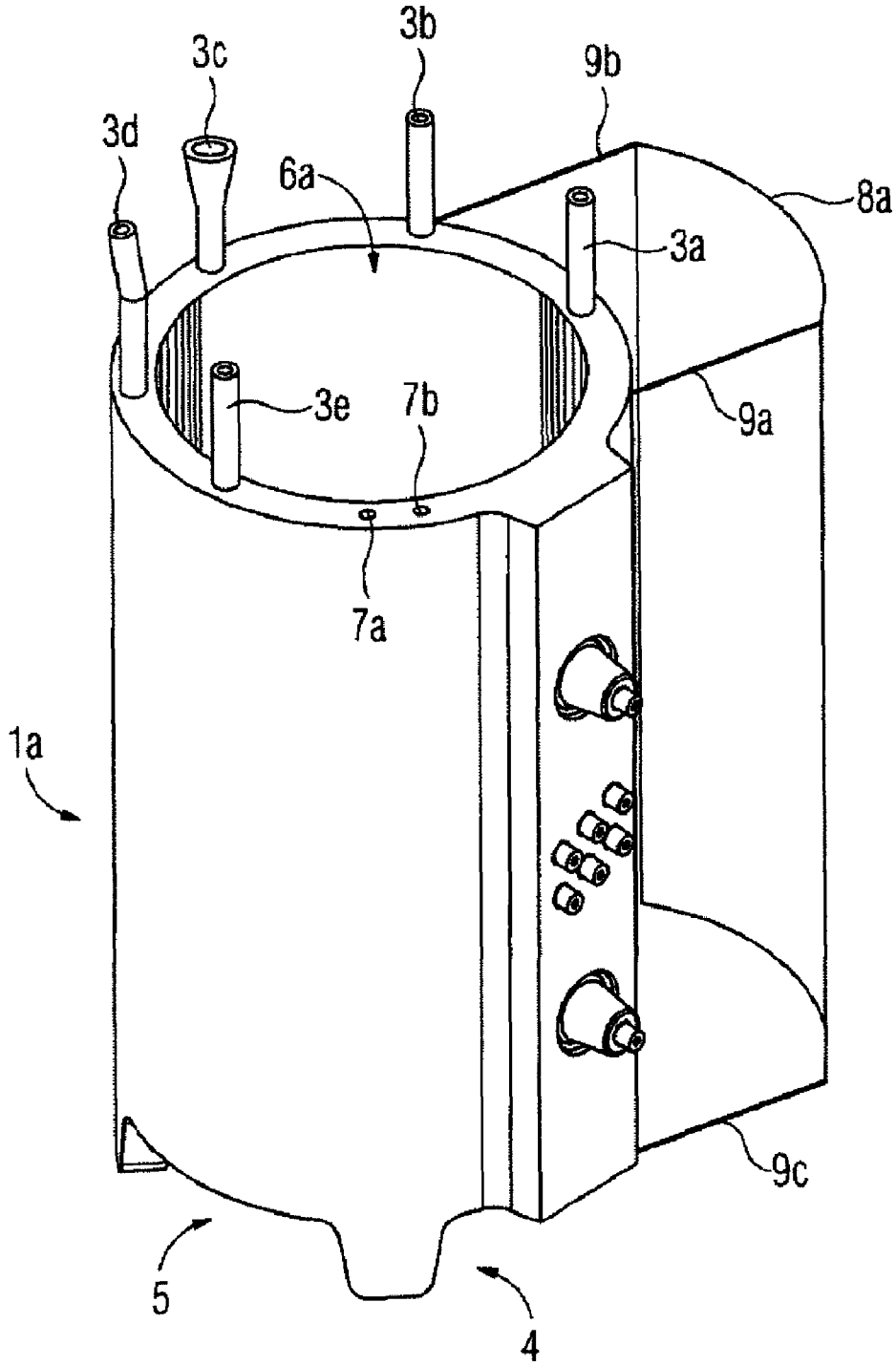
FIG. 2 shows a perspective side view of the electrical winding body with five extension elements and one side element.

FIG. 2 shows the electrical winding body 1*a* with feet 4 for forming at least one gap 5 through which the air can be sucked in under the electrical winding body 1*a*. Extension elements 3*a*, 3*b*, 3*c*, 3*d*, 3*e* are arranged on the upper end face of the electrical winding body 1*a*. The extension elements 3*a*, 3*b*, 3*c*, 3*d*, 3*e* are arranged on openings of continuous channels 10*a*, 10*b* (not illustrated), and lead to forced cooling within the continuous cooling channel 10*a*, 10*b*, by the cooling medium being carried away more strongly.

By way of example, two openings 7*a*, 7*b* in the continuous channels 10*a*, 10*b* are illustrated. A side element 8*a* is arranged in the radial direction—with respect to the longitudinal axis of the electrical winding body 1*a*—with holding elements 9*a*, 9*b*, 9*c* fixing the side element to the outer surface of the electrical winding body 1*a*.

Figure 3:
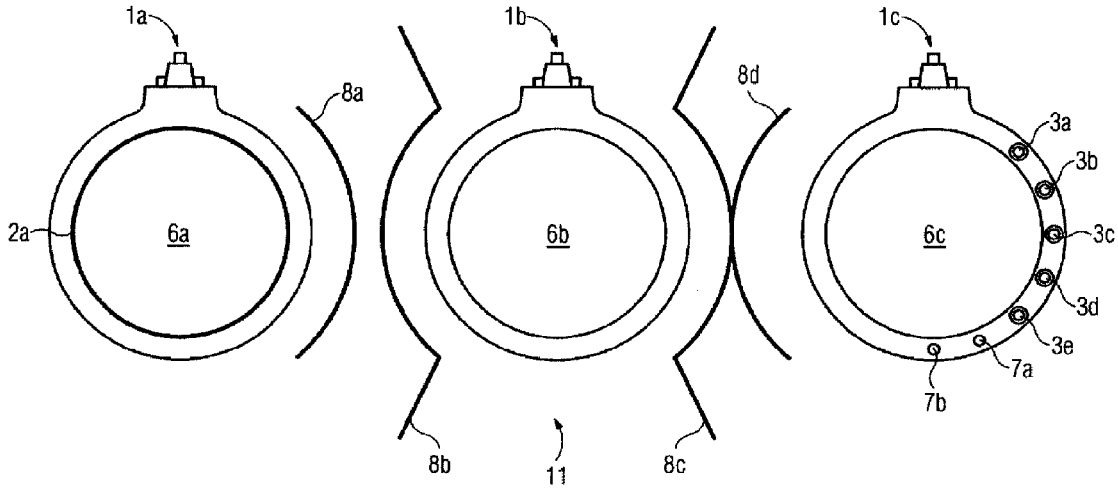
FIG. 3 shows a plan view of a three-limb arrangement with three electrical winding bodies, extension elements and side elements.

The plan view in FIG. 3 shows three electrical winding bodies 1*a*, 1*b*, 1*c* which are at least partially surrounded by a side element 8*a*, 8*b*, 8*c*, 8*d* and at least partially have extension elements 2*a*, 3*a*, 3*b*, 3*c*, 3*d*, 3*e*. The electrical winding body 1*a* for the first phase has an extension element 2*a* with respect to the center channel opening 6*a* in the electrical winding body 1*a*. This lengthens the channel 10*a* (not illustrated) of the center opening 6*a* upward. The center opening 6*a* can likewise be lengthened in the direction of the base, thus resulting in an extended continuous channel 10*a*, going beyond the external dimensions of the electrical winding body 1*a*. The first electrical winding body 1*a* is partially surrounded by a side element 8*a*.

For the second phase of a three-limb transformer, the second electrical winding body 1*b* is not provided with an extension element. The center electrical winding body 1*a* in fact has an air inlet 11 which is formed by the side elements 8*b*, 8*c*, through which the air is channeled to the electrical winding body 1*b*, and increases because of the heating within the electrical winding body 1*b*.

The right-hand side element 8*c* is directly connected to the adjacent side element 8*d* of the third electrical winding body 1*c*. Advantageously, the side elements 8*c*, 8*d* can be directly connected to one another and can be attached to a yoke, which is not illustrated. The third electrical winding body 1*c* has a plurality of extension elements 3*a*, 3*b*, 3*c*, 3*d*, 3*e*, which are arranged on the end face of the third electrical winding body 1*c*. The extension elements 3*a*, 3*b*, 3*c*, 3*d*, 3*e* can be selectively inserted into the openings 7*a*, 7*b* in the continuous channels 10*a*, 10*b*, in such a way that there is no need for an extension element 3*a*, 3*b*, 3*c*, 3*d*, 3*e* for each opening 7*a*, 7*b*, because of the thermal conditions within the cooling channel 10*a*, 10*b*.

In the chosen example shown in FIG. 3, an extension element 3*a*, 3*b*, 3*c*, 3*d*, 3*e* is not fitted in each cooling channel 10*a*, 10*b* in the third electrical winding body 1*c*.

Figure 4:
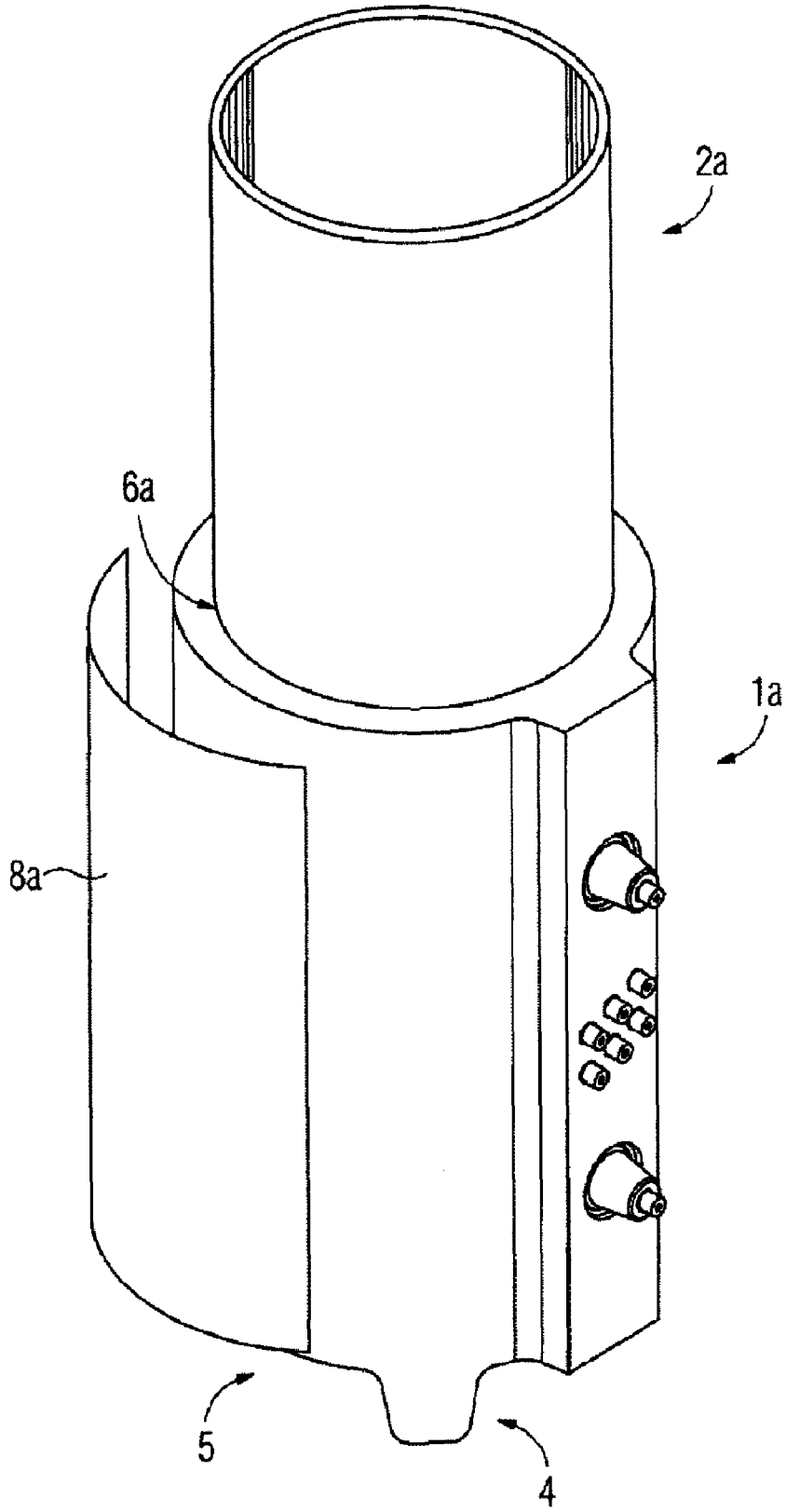
FIG. 4 shows a perspective view of the electrical winding body with one extension element and one side element.

FIG. 4 shows a perspective view of the electrical winding body 1*a* with an extension element 2*a* within the center opening 6*a*. A side element 8*a* is fitted to a subsection of the outer surface of the electrical winding body 1*a* and leads to forced cooling of the outer surface of the electrical winding body 1*a*, because of the intermediate space formed in this way. The integration of feet 4 in the electrical winding body 1*a* results in an intermediate space 5 being formed between the lower face of the electrical winding body 1*a* and the base. These measures ensure free circulation of the air in the continuous channels 10*a*, 10*b* (not illustrated).

Figure 5:
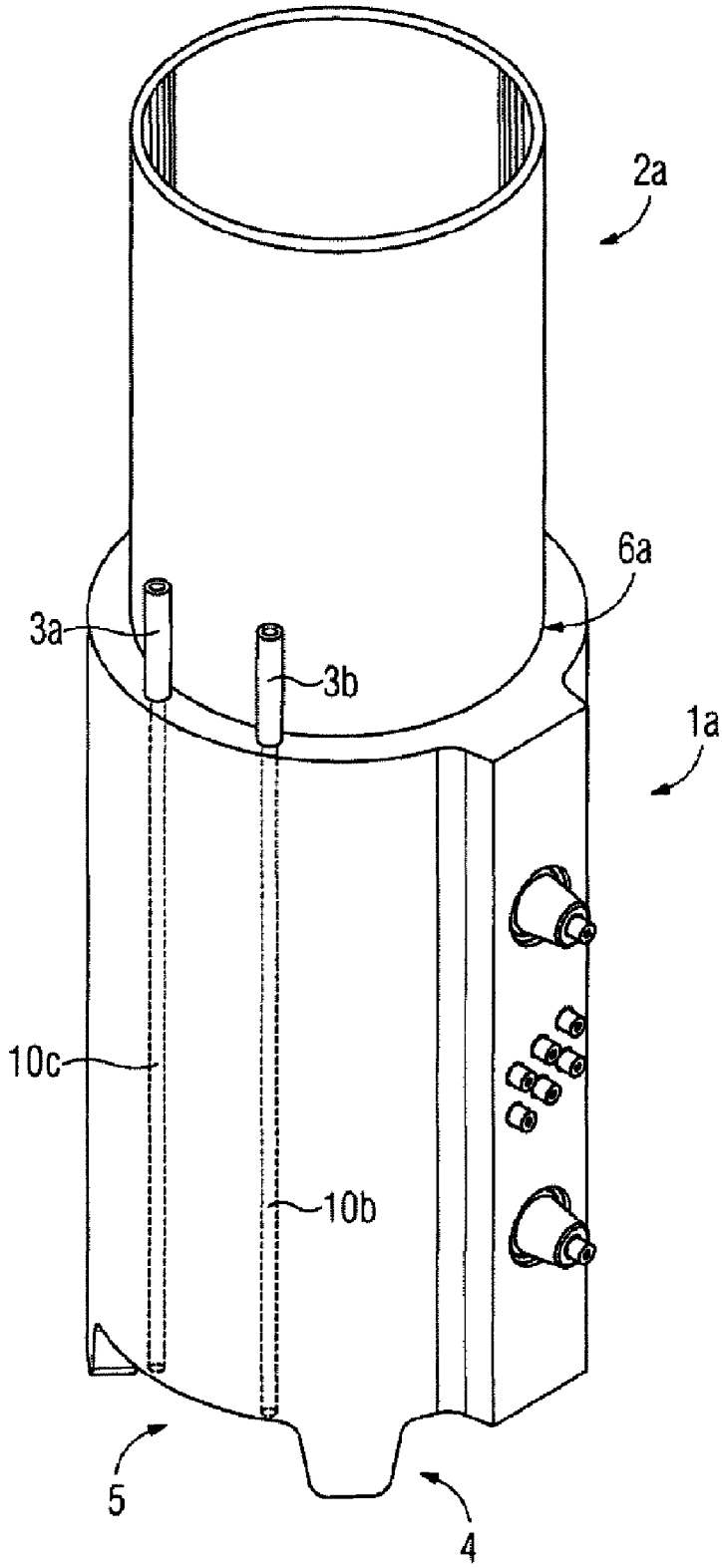
FIG. 5 shows a perspective view with three extension elements and indicated continuous cooling channels.

The perspective view in FIG. 5 shows an electrical winding body 1*a* with an extension element 2*a* of the center opening 6*a*. Furthermore, extension elements 3*a*, 3*b* relating to the openings 7*a*, 7*b*, (not illustrated) are arranged on the indicated continuous cooling channels 10*a*, 10*b* at the openings 7*a*, 7*b*. The example illustrated in FIG. 5 results on the one hand in forced cooling within the center channel 10*a* and the opening 6*a* through the extension element 2*a*, thus ensuring that the innermost winding of the winding body 1*a* is cooled. Furthermore, the extension elements 3*a*, 3*b* for the continuous channels 10*a*, 10*b* assist forced cooling in a center winding area, thus ensuring uniform cooling of the electrical winding body 1*a*.

Figure 6:
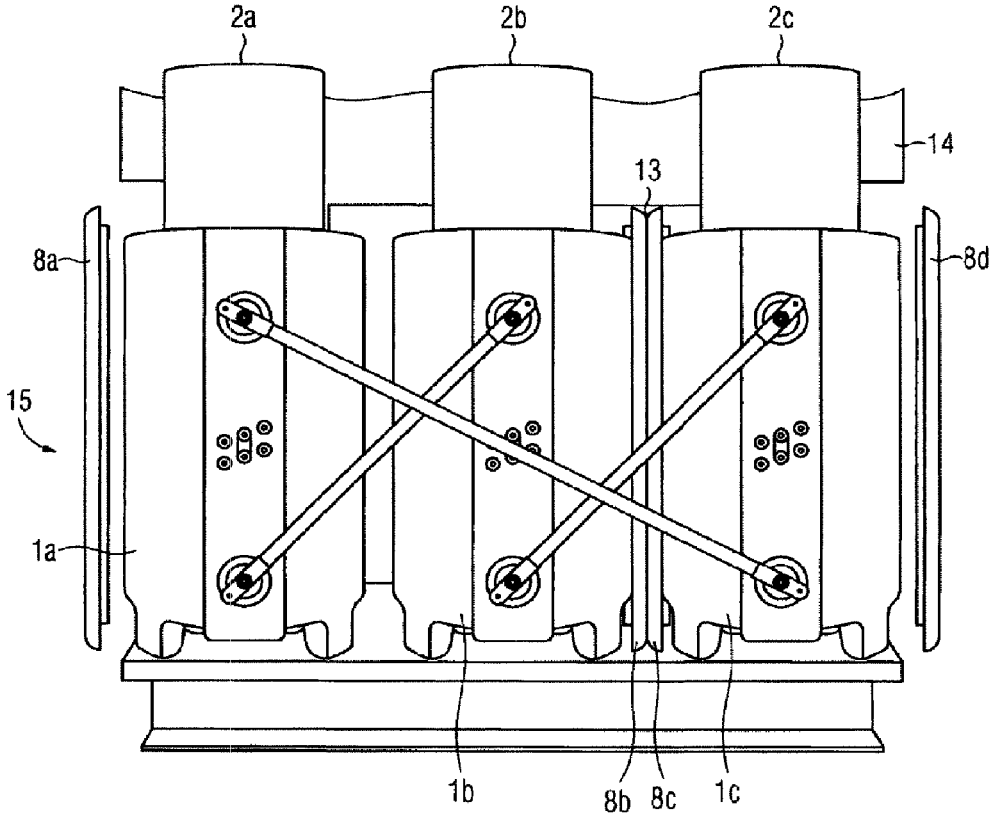
FIG. 6 shows a perspective view of the transformer according to the invention with three extension elements, which are cutout with respect to the yoke.

FIG. 6 shows a perspective view of the transformer 15 according to the invention with three extension elements 2*a*, 2*b*, 2*c*, which are cut out with respect to the yoke 14. A separating element 13 according to the invention is fitted between two electrical winding bodies 1*b*, 1*c*, and comprises two side elements 8*b*, 8*c* which are connected to one another at the rear. The separating element 13 is connected to the yoke 14. Furthermore, the outer side elements 8*a*, 8*d* likewise contribute to improved cooling of the transformer 15. The extension elements 2*a*, 2*b*, 2*c* go beyond the yoke 14, and are cut out with respect to the yoke 14. This allows the extension elements 2*a*, 2*b*, 2*c* to be fitted retrospectively. Furthermore, the extension elements 2*a*, 2*b*, 2*c* may be composed of segments which can be assembled, allow the segments of the extension elements 2*a*, 2*b*, 2*c* to be mounted individually at the front and rear, and then securely surround the yoke 14 by means of a suitable attachment.

Figure 7:
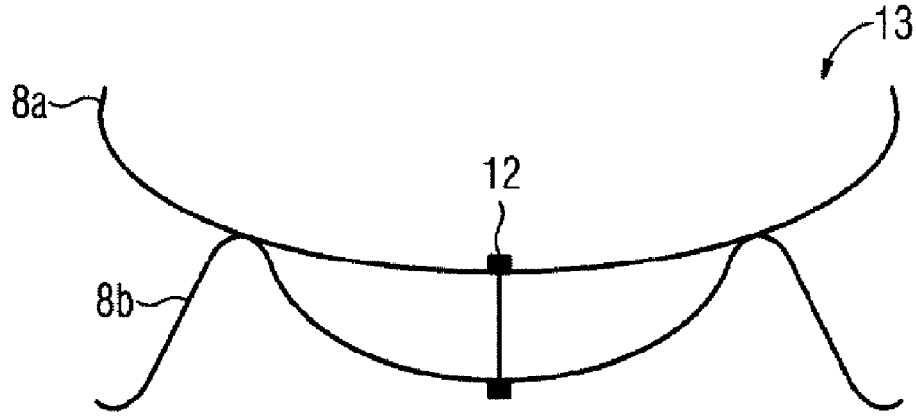
FIG. 7 shows a plan view of the separating element with a corrugated side element and a curved side element.

FIG. 7 shows a plan view of the separating element 13. Two differently shaped side elements 8*a*, 8*b* are connected to one another at the rear by means of a screw connection as an attachment element 12. The shape, in particular a corrugated shape, of one of the side elements 8*b* allows the shape of the side elements 8*a*, 8*b* to be varied deliberately by the predeterminable length of the screw connection 12.

Figure 8:
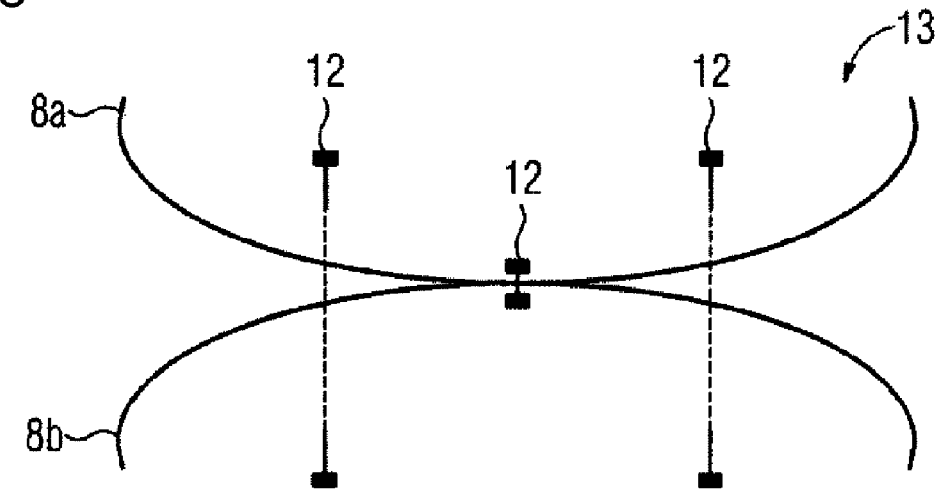
FIG. 8 shows a plan view of the separating element with two curved side elements and a plurality of attachment points.

The plan view in FIG. 8 shows the shaping of the side elements 8*a*, 8*b* of the separating element 13 by the use of a plurality of attachment elements 12. The deliberate placing of attachment elements 12 at selected attachment points on the side elements 8*a*, 8*b*, for example holes in the attachment points, allows the shape of the side elements 8*a*, 8*b*, and therefore of the separating element 13, to be predetermined by adjusting the length of the attachment elements 12, for example a screw connection.

The invention claimed is:

1. A transformer, comprising:

at least one core to be magnetized;

a yoke;

at least two limbs;

at least two electrical winding bodies each disposed on a respective one of said limbs, said at least two electrical winding bodies each having an electrically conductive winding and insulations each surrounding a respective one of said electrically conductive windings for mechanical sturdiness of said electrical winding bodies; and at least one separating element disposed between two of said electrical winding bodies, said at least one separating element having at least two side elements to be rearwardly fixed to one another;

at least one attachment element at a rear wall for fixing said at least two side elements of said at least one separating element, said at least one attachment element effecting a force on said at least two side elements influencing a shape of said at least two side elements.

2. The transformer according to claim 1, wherein said at least two side elements of said at least one separating element having a shape to be varied by a force from said at least one attachment element.

3. The transformer according to claim 2, wherein said shape of said at least two side elements to be varied is a corrugated shape.

4. The transformer according to claim 1, which further comprises a plurality of attachment elements, said at least two side elements of said at least one separating element having different attachment points, and said at least two side elements having a shape to be varied by a force from said plurality of attachment elements on said at least two side elements.

5. The transformer according to claim 1, wherein the transformer is a cast-resin transformer.

6. The transformer according to claim 1, wherein said at least one attachment element passes through said at least two side elements.

* * * * *